US008860623B2

(12) United States Patent
Lo et al.

(10) Patent No.: US 8,860,623 B2
(45) Date of Patent: Oct. 14, 2014

(54) ANTENNA SYSTEM WITH HIGH ISOLATION CHARACTERISTICS

(71) Applicant: Quanta Computer Inc., Tao Yuan Shien (TW)

(72) Inventors: Wen-Yuan Lo, Tao Yuan Shien (TW); Hui Lin, Tao Yuan Shien (TW); Chao-Hung Kuo, Tao Yuan Shien (TW); Jui-Chun Jao, Tao Yuan Shien (TW)

(73) Assignee: Quanta Computer Inc., Kuei Shan Hsiang, Tao Yuan Shien (TW)

( * ) Notice: Subject to any disclaimer, the term of this patent is extended or adjusted under 35 U.S.C. 154(b) by 171 days.

(21) Appl. No.: 13/742,935

(22) Filed: Jan. 16, 2013

(65) Prior Publication Data

US 2014/0139391 A1 May 22, 2014

(30) Foreign Application Priority Data

Nov. 20, 2012 (TW) ..... 101143189 A

(51) Int. Cl.
*H01Q 1/52* (2006.01)
*H01Q 21/28* (2006.01)

(52) U.S. Cl.
CPC ..... *H01Q 21/28* (2013.01); *H01Q 1/521* (2013.01)
USPC ..... 343/841; 343/702

(58) Field of Classification Search
USPC ..... 343/841, 702
See application file for complete search history.

(56) References Cited

U.S. PATENT DOCUMENTS

2012/0194391 A1* 8/2012 Liu et al. ..... 343/700 MS
2013/0069842 A1* 3/2013 Lee et al. ..... 343/853
2013/0257674 A1* 10/2013 Li et al. ..... 343/853

* cited by examiner

*Primary Examiner* — Dieu H Duong
(74) *Attorney, Agent, or Firm* — McClure, Qualey & Rodack, LLP

(57) ABSTRACT

An antenna system includes a first antenna, a second antenna, a band rejection filter, and a dielectric substrate. The band rejection filter is substantially disposed between the first antenna and the second antenna. The band rejection filter includes a protruded ground element, a main branch, a first extension branch, a first additional branch, and a second additional branch. The main branch substantially has a T-shape. The first extension branch is coupled to the main branch. The first additional branch is separated from the main branch, and a first coupling gap is formed between the first additional branch and the main branch. The second additional branch is separated from the main branch, and a second coupling gap is formed between the second additional branch and the first extension branch. The band rejection filter is configured to improve the isolation between the first antenna and the second antenna.

10 Claims, 5 Drawing Sheets

ANTENNA SYSTEM WITH HIGH ISOLATION CHARACTERISTICS

CROSS REFERENCE TO RELATED APPLICATIONS

This Application claims priority of Taiwan Patent Application No. 101143189 filed on Nov. 20, 2012, the entirety of which is incorporated by reference herein.

BACKGROUND OF THE INVENTION

1. Field of the Invention

The disclosure generally relates to an antenna system, and more particularly, relates to an antenna system with high isolation characteristics.

2. Description of the Related Art

With progress in mobile communication technology, mobile devices, for example, portable computers, mobile phones, tablet computer, multimedia players, and other hybrid functional portable electronic devices, have become more common To satisfy the demand of users, mobile devices usually can perform wireless communication functions. Some functions cover a large wireless communication area, for example, mobile phones using 2G, 3G, and LTE (Long Term Evolution) systems and using frequency bands of 700MHz, 850MHz, 900MHz, 1800MHz, 1900MHz, 2100MHz, 2300MHz, and 2500MHz. Some functions cover a small wireless communication area, for example, mobile devices using WLAN (Wireless Local Area Networks), Bluetooth, and WiMAX (Worldwide Interoperability for Microwave Access) systems and using frequency bands of 2.4GHz, 3.5GHz, 5.2GHz, and 5.8GHz.

To make a mobile device operate in multiple bands, an antenna designer should dispose a plurality of antennas in the mobile device. Since these antennas are close to each other, mutual interference is generated, and the radiation performance thereof is degraded.

BRIEF SUMMARY OF THE INVENTION

In one exemplary embodiment, the disclosure is directed to an antenna system, comprising: a first antenna; a second antenna; a band rejection filter, substantially disposed between the first antenna and the second antenna, wherein the band rejection filter comprises: a protruded ground element; a main branch, coupled to the protruded ground element, wherein the main branch substantially has a T-shape; a first extension branch, coupled to the main branch; a first additional branch, separated from the main branch, wherein a first coupling gap is formed between the first additional branch and the main branch; and a second additional branch, separated from the main branch, wherein a second coupling gap is formed between the second additional branch and the first extension branch; and a dielectric substrate, wherein the first antenna, the second antenna, and the band rejection filter are disposed on the dielectric substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof in the invention are shown in detail as follows.

Figure 1:
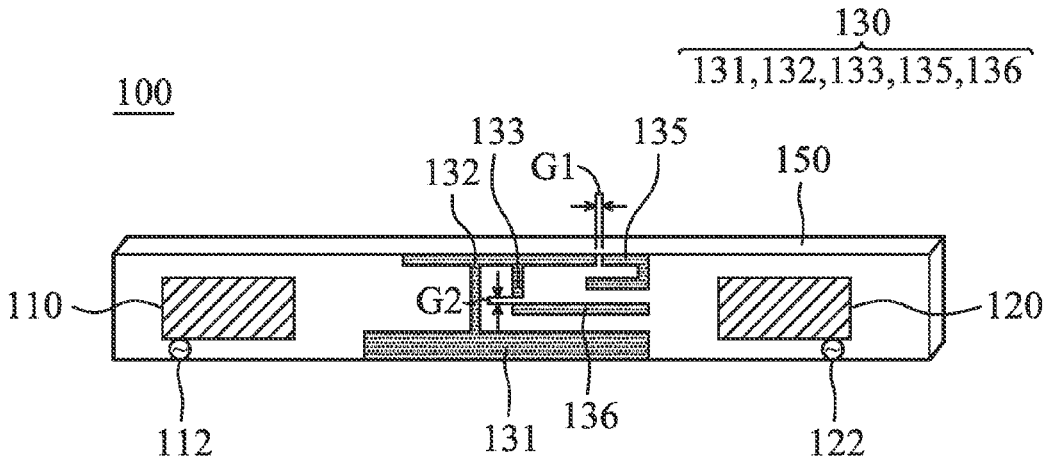
FIG. 1 is a diagram for illustrating an antenna system according to an embodiment of the invention.

FIG. 1 is a diagram for illustrating an antenna system 100 according to an embodiment of the invention. The antenna system 100 may be disposed in a variety of mobile devices, for example, a tablet computer or a notebook computer. As shown in FIG. 1, the antenna system 100 comprises a first antenna 110, a second antenna 120, a band rejection filter 130, and a dielectric substrate 150 (or a printed circuit board 150). The first antenna 110 is coupled to a first signal source 112, and the second antenna is coupled to a second signal source 122. The first antenna 110 and the second antenna 120 may operate in at least one same band, for example, a WLAN (Wireless Local Area Networks) band, a Bluetooth band, and a WWAN (Wireless Wide Area Networks) band, or an LTE (Long Term Evolution) band. Note that the types of the first antenna 110 and the second antenna 120 are not restricted in the invention. In some embodiments, any of the first antenna 110 and the second antenna 120 may be a monopole antenna, a loop antenna, a PIFA (Planar Inverted F Antenna), or a patch antenna. The band rejection filter 130 is substantially disposed between the first antenna 110 and the second antenna 120, and is configured to improve the isolation between the first antenna 110 and the second antenna 120. The dielectric substrate 150 may be an FR4 substrate or an FPCB (Flexible Printed Circuit Board). The first antenna 110, the second antenna 120, and the band rejection filter 130 are all disposed or printed on the dielectric substrate 150.

The band rejection filter 130 at least comprises a protruded ground element 131, a main branch 132, a first extension branch 133, a first additional branch 135, and a second additional branch 136. The foregoing components of the band rejection filter 130 may be all made of metal, for example, copper, aluminum, or silver. In some embodiments, the protruded ground element 131 is coupled to a ground element (not shown), and the first signal source 112 is coupled between the first antenna 110 and the ground element, and the second signal source 122 is coupled between the second antenna 120 and the ground element. The main branch 132 is coupled to the protruded ground element 131. The first extension branch 133 is coupled to the main branch 132. In some embodiments, the main branch 132 substantially has a T-shape, and the first extension branch 133 substantially has an I-shape. The first additional branch 135 is separated from the main branch 132, and a first coupling gap G1 is formed between the first additional branch 135 and the main branch 132. The second additional branch 136 is also separated from the main branch 132, and a second coupling gap G2 is formed between the second additional branch 136 and the first extension branch 133. Each of the first coupling gap G1 and the second coupling gap G2 should be smaller than 2mm. In some embodiments, the first additional branch 135 substantially has a U-shape, and the second additional branch 136 substantially has an I-shape.

In some embodiments, the first antenna 110 and the second antenna 120 both operate in a first band (low band) and a second band (high band). The band rejection filter 130 is configured to improve the isolation between the first antenna 110 and the second antenna 120 in the first band and the second band. More particularly, a long resonant path formed by the protruded ground element 131, the main branch 132, the first extension branch 133, the first additional branch 135, and the second additional branch 136 is arranged to improve the isolation in the first band, and a short resonant path formed by the first additional branch 135 and the second additional branch 136 is arranged to improve the isolation in the second band. In a preferred embodiment, the first band is approximately from 2400MHz to 2500MHz, and the second band is approximately from 5150MHz to 5850MHz. Accordingly, the invention is capable of improving the isolation between the first antenna 110 and the second antenna 120 in the WLAN band and the Bluetooth band.

Figure 2:
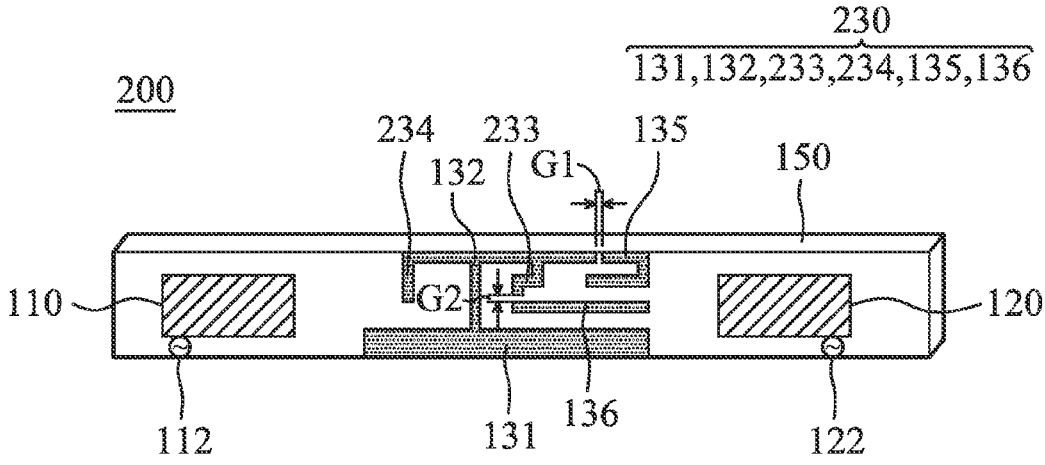
FIG. 2 is a diagram for illustrating an antenna system according to another embodiment of the invention.

FIG. 2 is a diagram for illustrating an antenna system 200 according to another embodiment of the invention. FIG. 2 is similar to FIG. 1. In the embodiment, a first extension branch 233 of a band rejection filter 230 of the antenna system 200 has a meandering shape, and substantially has an N-shape. In addition, the band rejection filter 230 further comprises a second extension branch 234. The first extension branch 233 and the second extension branch 234 are substantially disposed at two opposite ends of the main branch 132, respectively. The second extension branch 234 is coupled to the main branch 132, and substantially has an I-shape. As a matter of fact, the first extension branch 233 and the second extension branch 234 can be both meandering to form a variety of shapes to provide desired resonant lengths. Other features of the antenna system 200 of FIG. 2 are similar to those of the antenna system 100 of FIG. 1. Accordingly, these embodiments can achieve similar performances.

Figure 3:
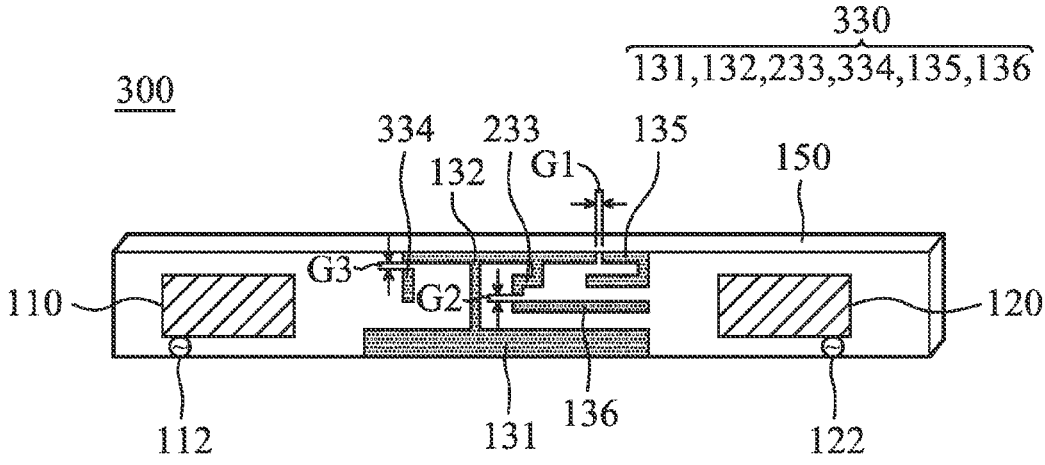
FIG. 3 is a diagram for illustrating an antenna system according to an embodiment of the invention.

FIG. 3 is a diagram for illustrating an antenna system 300 according to an embodiment of the invention. FIG. 3 is similar to FIG. 2. In the embodiment, a second extension branch 334 of a band rejection filter 330 of the antenna system 300 is separated from the main branch 132, and a third coupling gap G3 is formed between the second extension branch 334 and the main branch 132. The second extension branch 334 substantially has an I-shape. The third coupling gap G3 should be smaller than 2mm. Other features of the antenna system 300 of FIG. 3 are similar to those of the antenna system 200 of FIG. 2. Accordingly, these embodiments can achieve similar performances.

Figure 4:
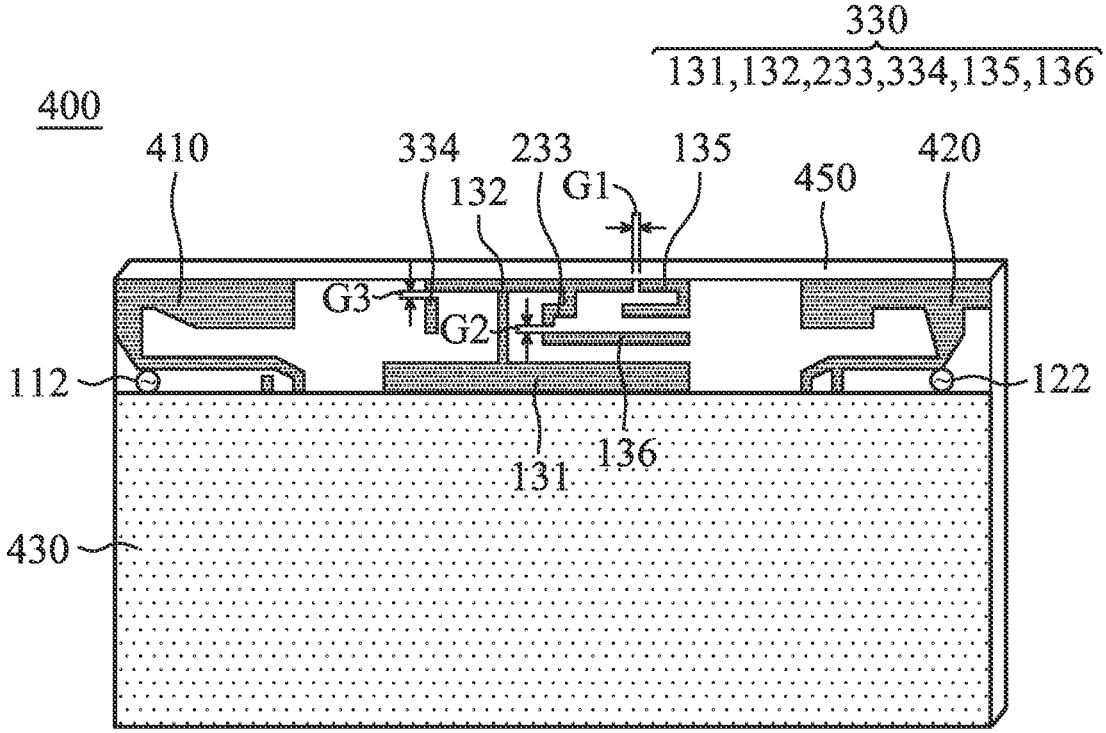
FIG. 4 is a diagram for illustrating an antenna system according to another embodiment of the invention.

FIG. 4 is a diagram for illustrating an antenna system 400 according to another embodiment of the invention. FIG. 4 is similar to FIG. 3. In the embodiment, the antenna system 400 further comprises a ground plane 430, which is disposed on a dielectric substrate 450 of the antenna system 400. The width of the ground plane 430 is greater than that of the protruded ground element 131. The operation bands of the band rejection filter 330 may be controlled by changing the shape of the ground plane 430. The ground plane 430 may be made of copper foil. The protruded ground element 131 is coupled to the ground plane 430 to form a system ground plane. As shown in FIG. 4, a first antenna 410 and a second antenna 420 of the antenna system 400 are both PIFAs (Planar Inverted F Antennas). The first signal source 112 is coupled between the first antenna 410 and the system ground plane, and the second signal source 122 is coupled between the second antenna 420 and the system ground plane. The first antenna 410 and the second antenna 420 may be fed via coaxial cables (not shown). Other features of the antenna system 400 of FIG. 4 are similar to those of the antenna system 300 of FIG. 3. Accordingly, these embodiments can achieve similar performances.

Figure 5:
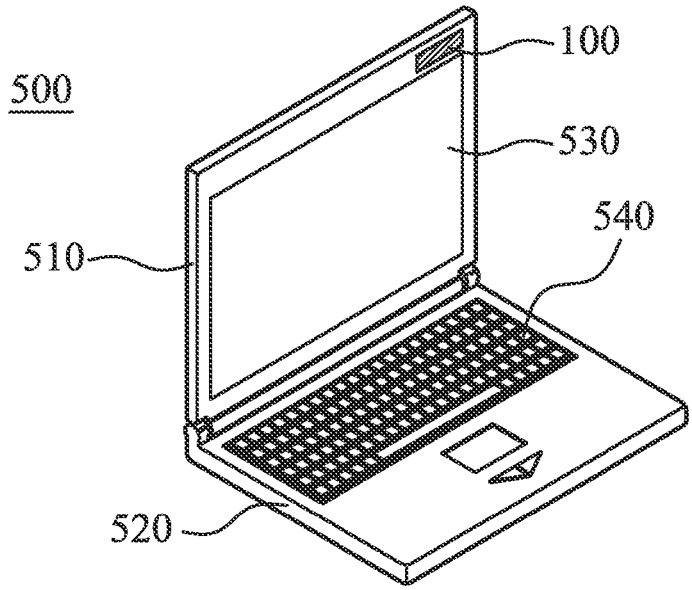
FIG. 5 is a diagram for illustrating a notebook computer according to an embodiment of the invention.

FIG. 5 is a diagram for illustrating a notebook computer 500 according to an embodiment of the invention. As shown in FIG. 5, the notebook computer 500 comprises a top cover 510 and a bottom cover 520. The top cover 510 at least comprises a display device 530 and the antenna system 100. The bottom cover 520 at least comprises a keyboard 540. The notebook computer 500 may further comprise other components, such as a mouse, a battery, a processor, and a touch module (not shown). In the embodiment, the antenna system 100, as shown in FIG. 1, is disposed adjacent to the display device 530 of the notebook computer 500. For example, the antenna system 100 may be disposed above the display device 530. Since the band rejection filter 130 is included, the first antenna 110 and the second antenna 120 of the antenna system 100 do not interfere with each other much, and the antenna system 100 enables the notebook computer 500 to perform wireless data transmission in the WLAN band and the Bluetooth band simultaneously. Note that the antenna systems 200, 300, and 400 as shown in FIGS. 2, 3, and 4 may be applied to the embodiment of FIG. 5.

Figure 6A:
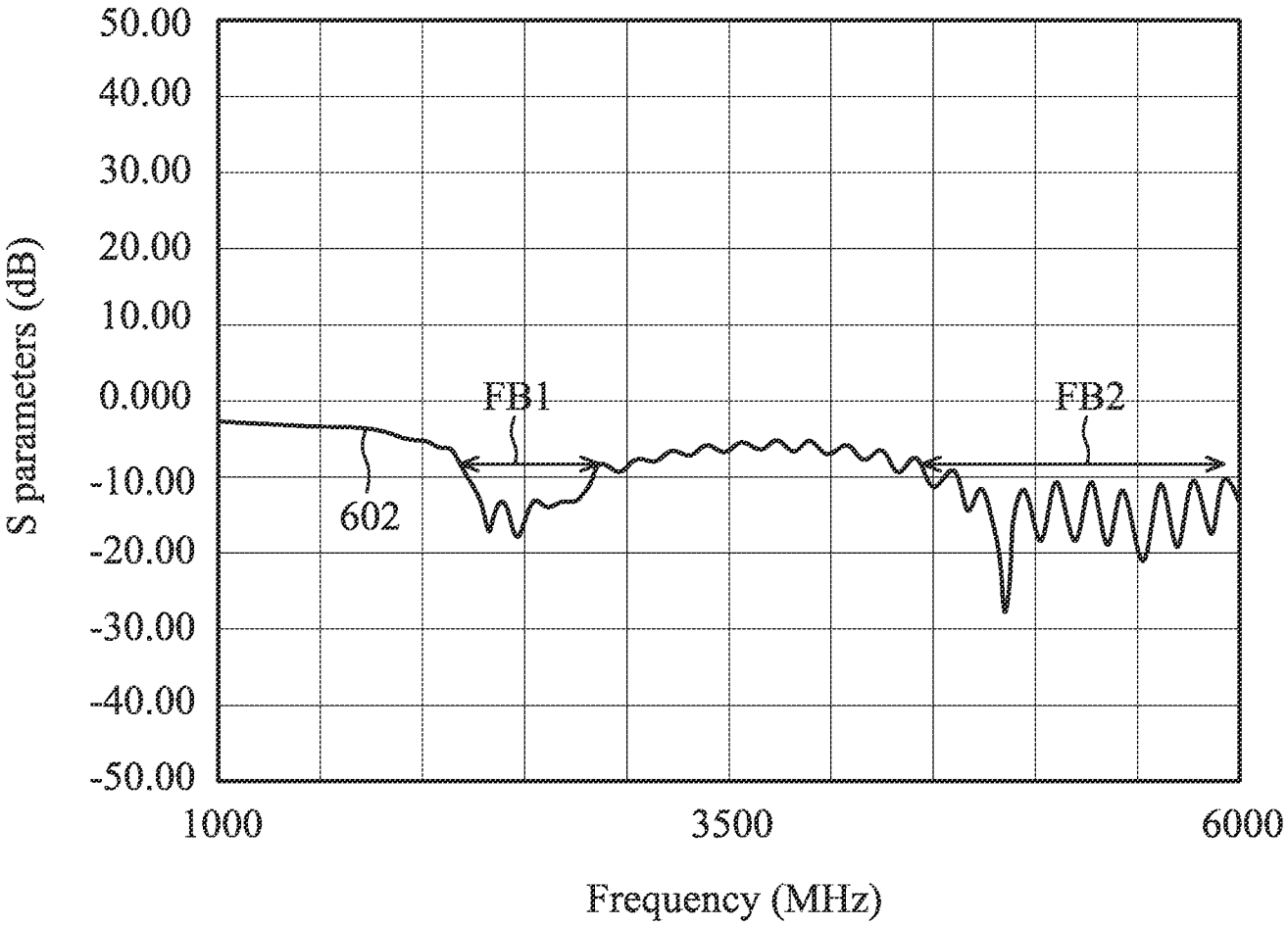
FIG. 6A is a diagram for illustrating S parameters of an antenna system according to an embodiment of the invention.

FIG. 6A is a diagram for illustrating S parameters of the antenna system 400 according to an embodiment of the invention. The horizontal axis represents operation frequency (MHz), and the vertical axis represents S parameters (dB). The curve 602 represents the reflection coefficient (S11) of the first antenna 410 of the antenna system 400. As shown in FIG. 6A, the first antenna 410 at least covers a first band FB1 and a second band FB2. The first band FB1 is approximately from 2400MHz to 2500MHz, and the second band FB2 is approximately from 5150MHz to 5850MHz.

Figure 6B:
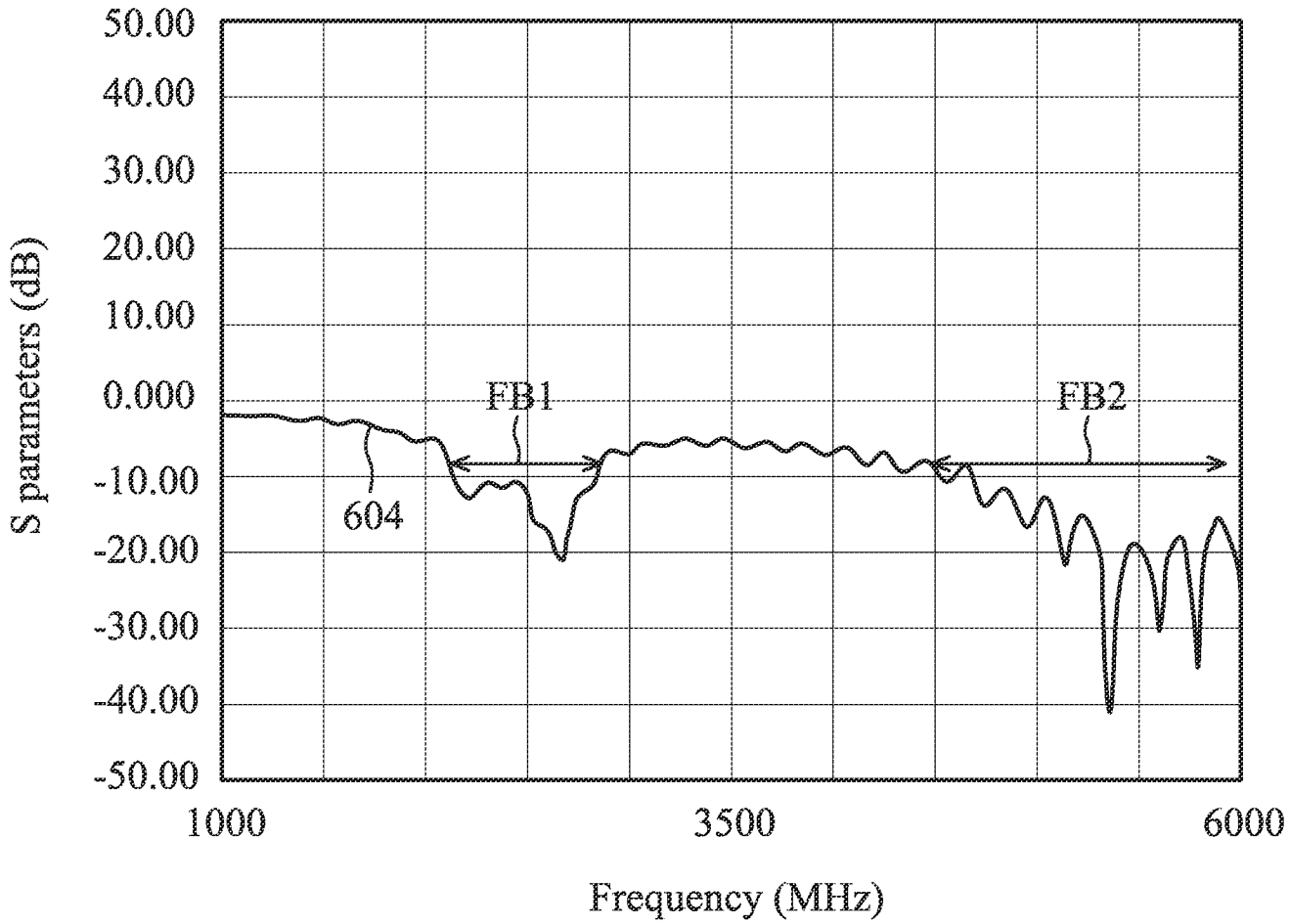
FIG. 6B is a diagram for illustrating S parameters of an antenna system according to an embodiment of the invention.

FIG. 6B is a diagram for illustrating S parameters of the antenna system 400 according to an embodiment of the invention. The horizontal axis represents operation frequency (MHz), and the vertical axis represents S parameters (dB). The curve 604 represents the reflection coefficient (S22) of the second antenna 420 of the antenna system 400. As shown in FIG. 6B, the second antenna 420 at least covers a first band FB1 and a second band FB2. The first band FB1 is approximately from 2400MHz to 2500MHz, and the second band FB2 is approximately from 5150MHz to 5850MHz.

Figure 6C:
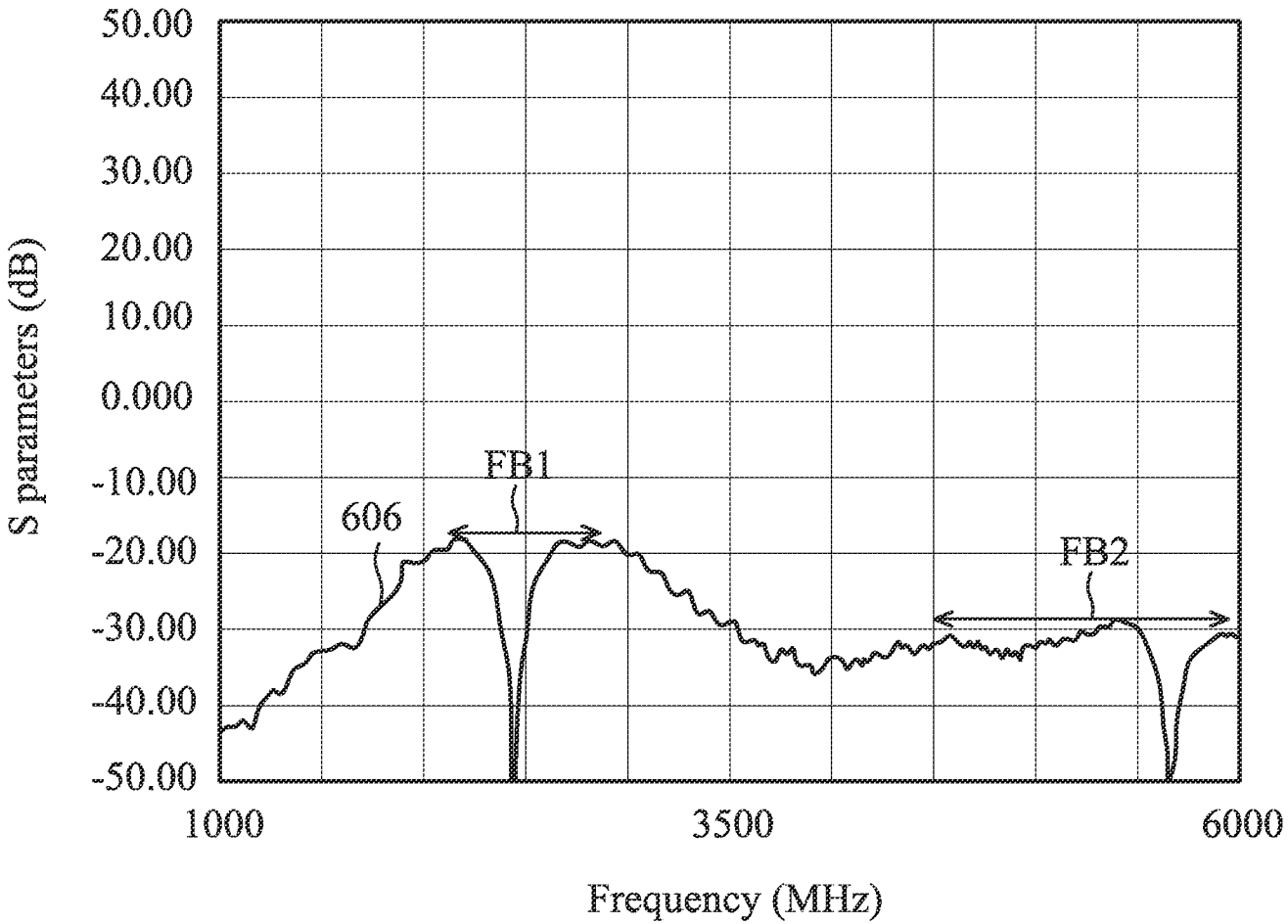
FIG. 6C is a diagram for illustrating S parameters of an antenna system according to an embodiment of the invention.

FIG. 6C is a diagram for illustrating S parameters of the antenna system 400 according to an embodiment of the invention. The horizontal axis represents operation frequency (MHz), and the vertical axis represents S parameters (dB). The curve 606 represents the isolation (S21) between the first antenna 410 and the second antenna 420 of the antenna system 400. As shown in FIG. 6C, in the first band FB1 and the second band FB2, the isolation (S21) between the first antenna 410 and the second antenna 420 can reach to −30dB, and further to −50dB at best. Since the band rejection filter 330 can attract surface currents on the ground plane 430 in the first band FB1 and the second band FB2, the mutual coupling between the first antenna 410 and the second antenna 420 is reduced, and the isolation (S21) between the first antenna 410 and the second antenna 420 is improved. According to measurements, the band rejection filter 330 does not negatively affect the antenna efficiency of the first antenna 410 and the second antenna 420, and the antenna efficiency reaches to about 40.8% to 53.1%, meeting requirements of practical applications. Note that the antenna systems 100, 200, and 300 as shown in FIGS. 1, 2, and 3 have similar principles of operations.

The above element sizes, element shapes, and frequency ranges are not restricted in the invention. These parameters may be adjusted by a designer according to different requirements.

The antenna system with high isolation characteristics in the invention may be implemented on a single dielectric substrate (or a single printed circuit board). The invention has advantages of reducing the size and reducing the material costs, and is suitably applied to a variety of small mobile devices.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. An antenna system, comprising:

a first antenna;

a second antenna;

a band rejection filter, substantially disposed between the first antenna and the second antenna, wherein the band rejection filter comprises:

a protruded ground element;

a main branch, coupled to the protruded ground element, wherein the main branch substantially has a T-shape;

a first extension branch, coupled to the main branch;

a first additional branch, separated from the main branch, wherein a first coupling gap is formed between the first additional branch and the main branch; and a second additional branch, separated from the main branch, wherein a second coupling gap is formed between the second additional branch and the first extension branch; and a dielectric substrate, wherein the first antenna, the second antenna, and the band rejection filter are disposed on the dielectric substrate.

2. The antenna system as claimed in claim 1, wherein the first antenna and the second antenna both operate in a first band and a second band, and the band rejection filter is configured to improve isolation between the first antenna and the second antenna in the first band and the second band, wherein the first band is approximately from 2400MHz to 2500MHz, and the second band is approximately from 5150MHz to 5850MHz.

3. The antenna system as claimed in claim 1, wherein the first extension branch substantially has an N-shape.

4. The antenna system as claimed in claim 1, wherein the first additional branch substantially has a U-shape.

5. The antenna system as claimed in claim 1, wherein the second additional branch substantially has an I-shape.

6. The antenna system as claimed in claim 1, wherein the band rejection filter further comprises:

a second extension branch, coupled to the main branch, wherein the second extension branch substantially has an I-shape.

7. The antenna system as claimed in claim 1, wherein the band rejection filter further comprises:

a second extension branch, separated from the main branch, wherein the second extension branch substantially has an I-shape, and a third coupling gap is formed between the second extension branch and the main branch.

8. The antenna system as claimed in claim 7, wherein each of the first coupling gap, the second coupling gap, and the third coupling gap is smaller than 2mm.

9. The antenna system as claimed in claim 1, wherein the first antenna and the second antenna are PIFAs (Planar Inverted F Antennas).

10. The antenna system as claimed in claim 1, wherein the antenna system is disposed adjacent to a display of a notebook computer.

* * * * *